US006692229B2

(12) United States Patent
Metz

(10) Patent No.: US 6,692,229 B2
(45) Date of Patent: Feb. 17, 2004

(54) LAMINAR FLOW AIR MOVER

(76) Inventor: Donald Metz, 6462 Ridings Rd., Syracuse, NY (US) 13206

( * ) Notice: Subject to any disclaimer, the term of this patent is extended or adjusted under 35 U.S.C. 154(b) by 0 days.

(21) Appl. No.: 10/162,196

(22) Filed: Jun. 5, 2002

(65) Prior Publication Data

US 2003/0228216 A1 Dec. 11, 2003

(51) Int. Cl.[7] ..... F04D 29/44
(52) U.S. Cl. ..... 415/206; 415/211.2; 415/213.1
(58) Field of Search ..... 415/203, 206, 415/211.2, 213.1

(56) References Cited

U.S. PATENT DOCUMENTS 3,421,687 A 1/1969 Daily
5,439,349 A * 8/1995 Kupferberg ..... 415/212.1
5,983,890 A * 11/1999 Thomas et al. ..... 126/512

* cited by examiner

*Primary Examiner*—Ninh H. Nguyen
(74) *Attorney, Agent, or Firm*—Sughrue Mion, PLLC

(57) ABSTRACT

A laminar flow air mover includes a centrifugal fan having an outlet connected to a conduit system detachably mounted relative to the air mover. The conduit system includes a first portion connected to the centrifugal blower having a first diameter and an outlet portion having a reduced diameter portion relative to the first portion. A plurality of parallel pipes are mounted in parallel within the outlet portion in such a manner so as to direct the entire flow of air from the centrifugal blower through the pipes to provide a coherent flow of air for a substantial distance from the outlet portion.

5 Claims, 5 Drawing Sheets

LAMINAR FLOW AIR MOVER

BACKGROUND OF THE INVENTION

The present invention is directed to a laminar flow air mover and more specifically to a centrifugal blower having forwardly curved blades inclined in the direction of the rotation of the impeller and having a conduit secured to the outlet of the centrifugal blower. A plurality of pipes having a substantially smaller diameter than the diameter of the conduit are secured in parallel in the outlet end of the conduit in such a manner so as to direct the entire flow of air from the centrifugal blower through the pipes. The laminar air flow created by the pipes creates a coherent flow of air which is capable of moving substantial distances from the outlet of the conduit before dissipating.

The use of cylindrical pipes disposed in parallel within a cylindrical conduit is disclosed in the U.S. Patent to Daily U.S. Pat. No. 3,421,687. Although such an arrangement is capable of creating a column of air adapted to extend from the floor on which the fan is placed to the ceiling of a room to provide improved temperature control, the effective length of the column of air is substantially limited by the fact that spaces are left between the tubular pipes and the fact that the disclosed fan is an axial impeller type fan which creates a low pressure swirling air mass.

SUMMARY OF THE INVENTION

The present invention provides a new and improved laminar flow air mover assembly which is capable of providing a coherent air flow for a distance of approximately 55 feet. Thus the laminar air flow mover is suitable for directing a coherent flow of air the entire length of the largest road trailer available today to provide a significantly improved air cooling or heating system for the trailer. The entire laminar air flow mover assembly is mountable within a building having a loading platform adjacent the door of the building aligned with the open rear end of a trailer. The air mover assembly is adjustably mounted on a support adjacent the door opening so as to locate the outlet of the conduit in alignment with the door opening of the building to direct the flow of air into the trailer.

DETAILED DESCRIPTION OF THE INVENTION

Figure 1:
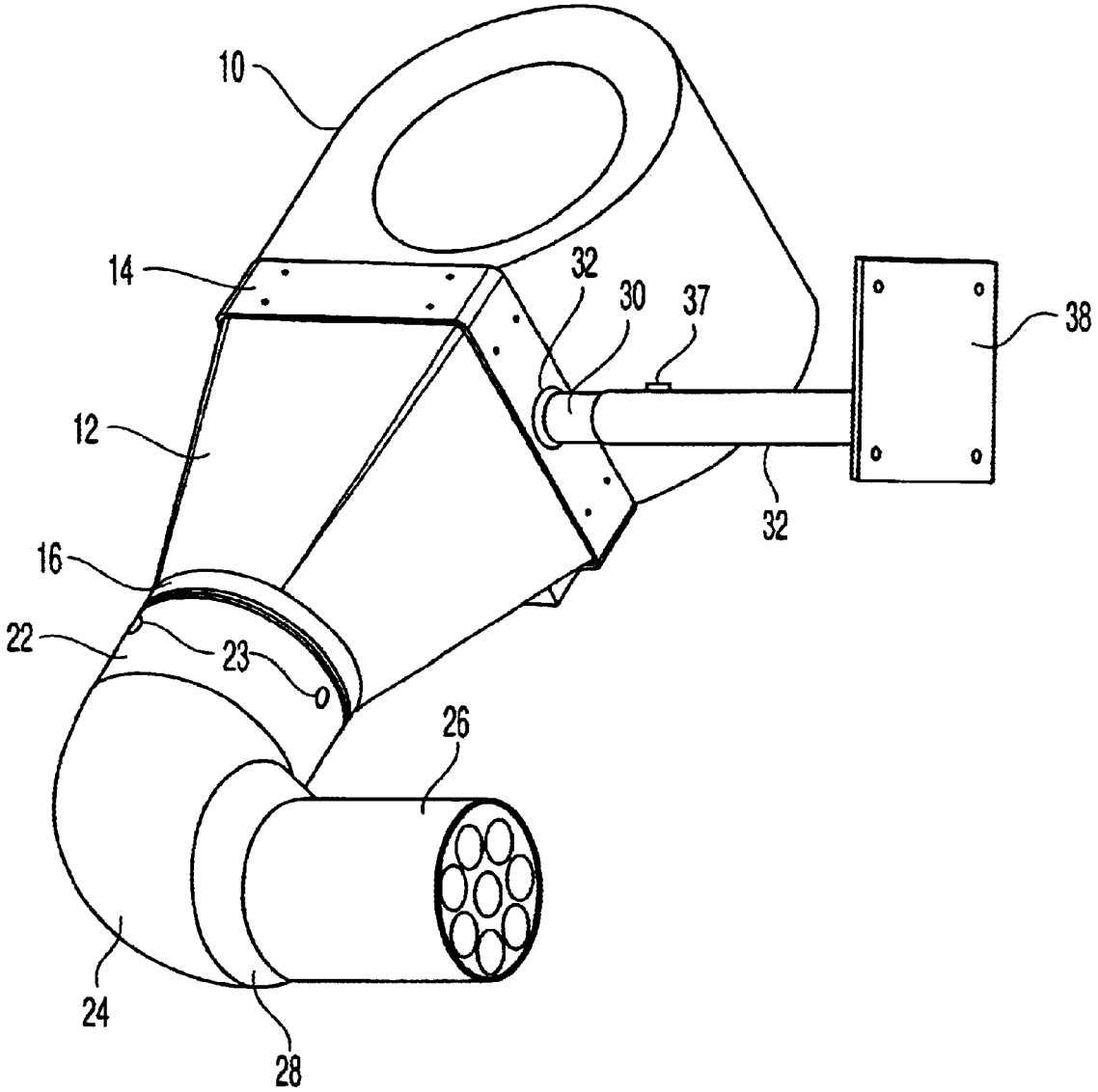
FIG. 1 is a perspective view of the laminar flow air mover assembly.

The laminar flow air mover assembly shown in FIG. 1 is comprised of a centrifugal blower 10 having an outlet pipe 12 connected thereto. The outlet pipe has a rectangular connector 14 securing one end of the pipe 12 to the housing of the centrifugal blower 10. A cylindrical member 20 is connected to the opposite end of the outlet pipe by a cylindrical flange 16. An outlet conduit 18 is comprised of a first cylindrical portion 22 connected to the cylindrical member 20 at one end and an elbow section 24 at the opposite end. A smaller diameter conduit section 26 is connected to the elbow member 24 by means of a tapered annular connector 28.

Figure 2:
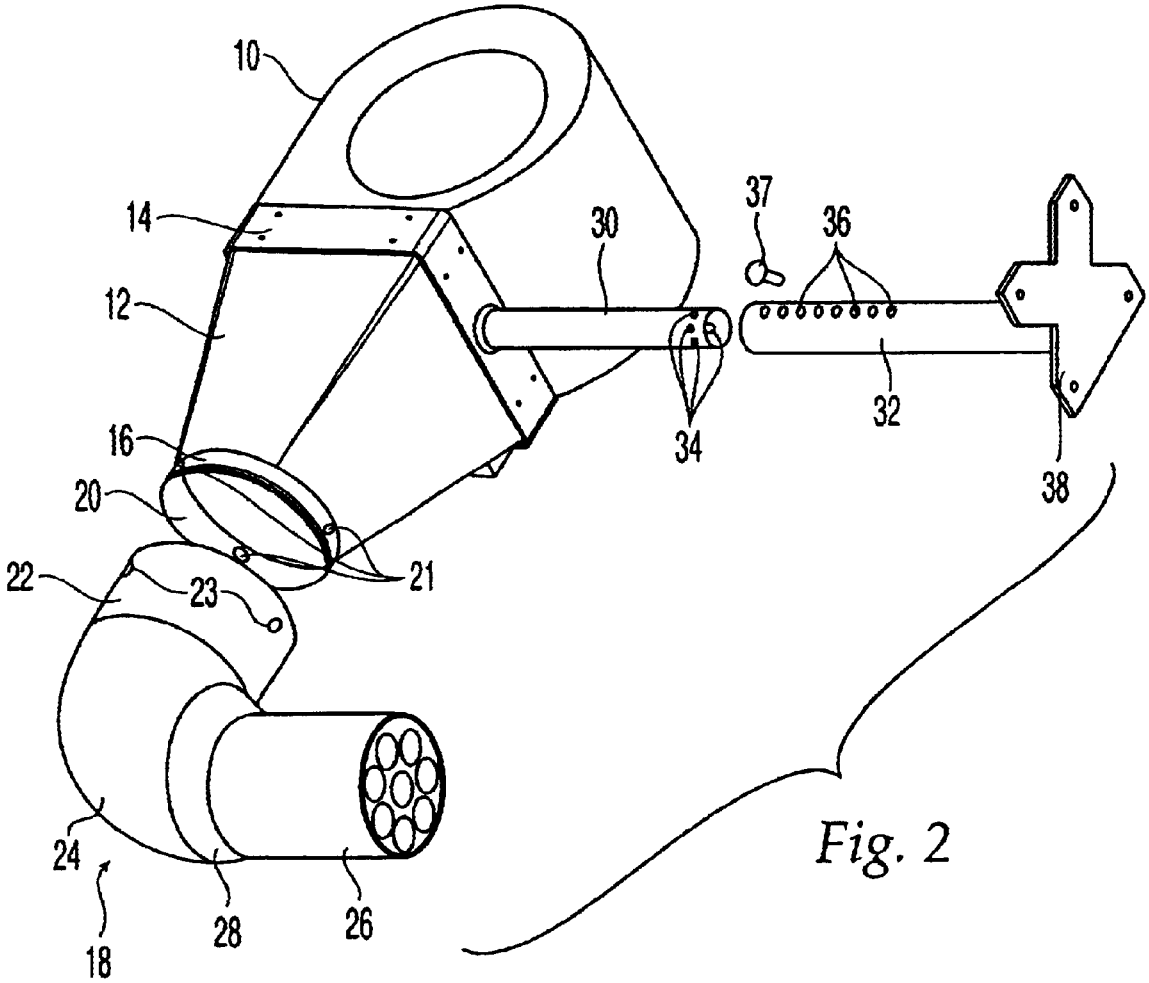
FIG. 2 is an exploded view of the assembly in FIG. 1.

The cylindrical member 20 is provided with three equally inwardly directed protrusions defining recesses 21 in the outer surface of the member 20. The cylindrical portion 22 is also provided with three inwardly directed protrusions 23, only two of which are visible in FIGS. 1 and 2, which engage the recesses 21 in the member 20 to connect the portion 22 of the outlet conduit 18 with the member 20. Since both member 20 and 22 are made of flexible plastic material a break-away connection is provided so that the outlet conduit 18 will readily separate from the blower assembly upon impact to the outlet conduit 18 by a fork-lift truck or the like passing through the door. The outlet conduit can readily be snap-engaged again.

The outlet end of the elbow pipe 24 has a diameter of 8 inches and the diameter of the conduit section 26 has a diameter of 6½ inches. This step down arrangement with respect to the outlet conduit provides a certain degree of back pressure to the centrifugal blower. It is well known that a centrifugal blower needs a certain amount of back pressure in order to operate more efficiently.

A mounting assembly for the centrifugal blower is comprised of a first smaller diameter pipe 30 and a larger diameter pipe 32 which are telescopically mounted with respect to each other. One end of the first pipe 30 is connected to the flange 14 by means of a mounting bracket 32. A plurality of circumferentially spaced holes 34 are provided in the first pipe 30 adjacent the opposite end of the pipe. The larger diameter pipe 32 is provided with a plurality of holes 36 disposed in a line extending lengthwise of the pipe. Additional holes are provided diametrically of the illustrated holes 36. Thus when the first pipe 30 is telescopically mounted within the second pipe a pin 37 or any other suitable type of fastener may extend through selected holes 34, 36 to adjust the telescopic length of the pipes and the angular rotation of one pipe relative to the other. A mounting bracket 38 is provided at one end of the larger pipe 32 for mounting the pipe on a wall of the warehouse adjacent the loading platform door.

Figure 3:
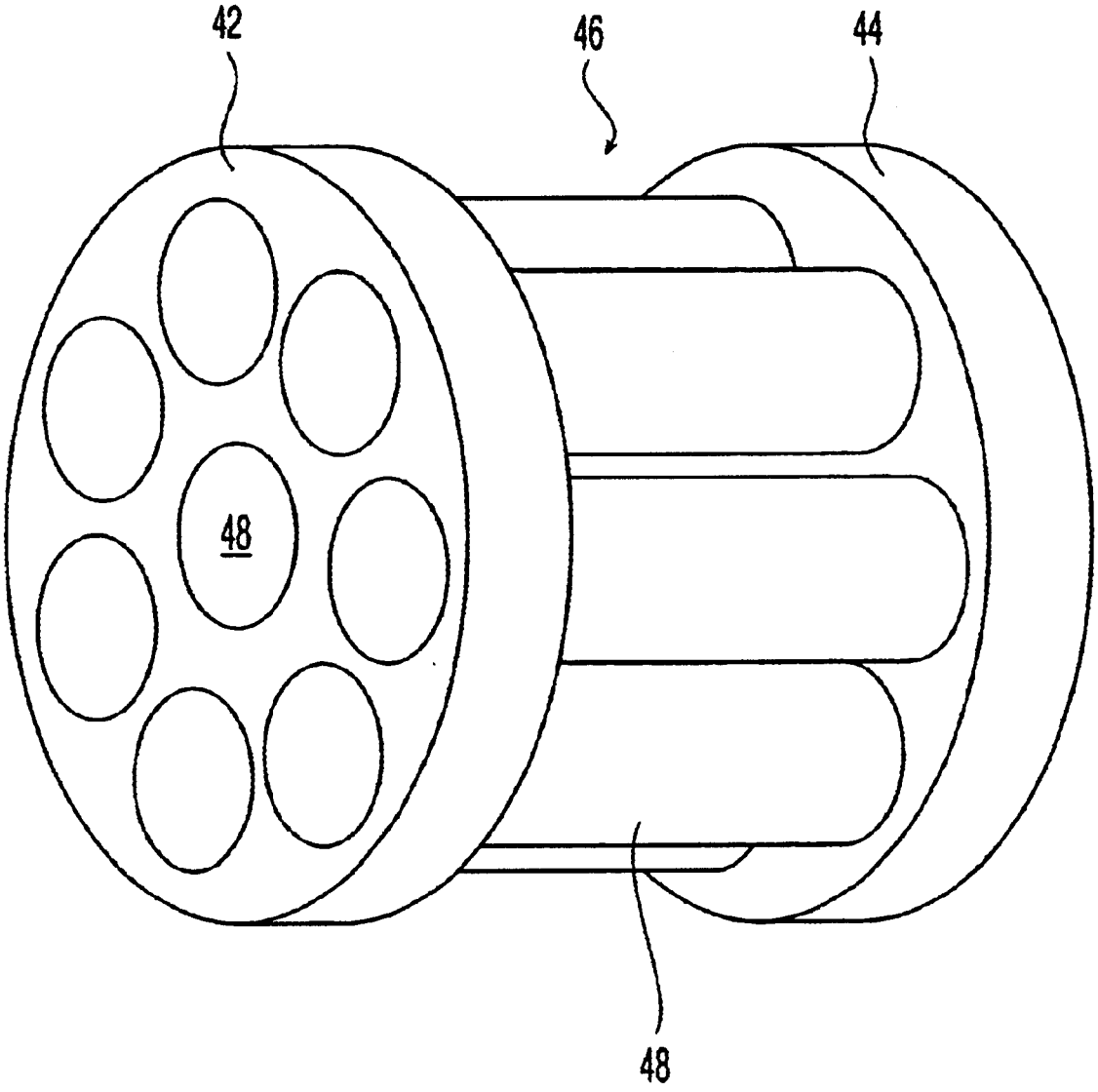
FIG. 3 is a perspective view of the multiple tubular pipe assembly adapted to be mounted in the outlet conduit.
Figure 4:
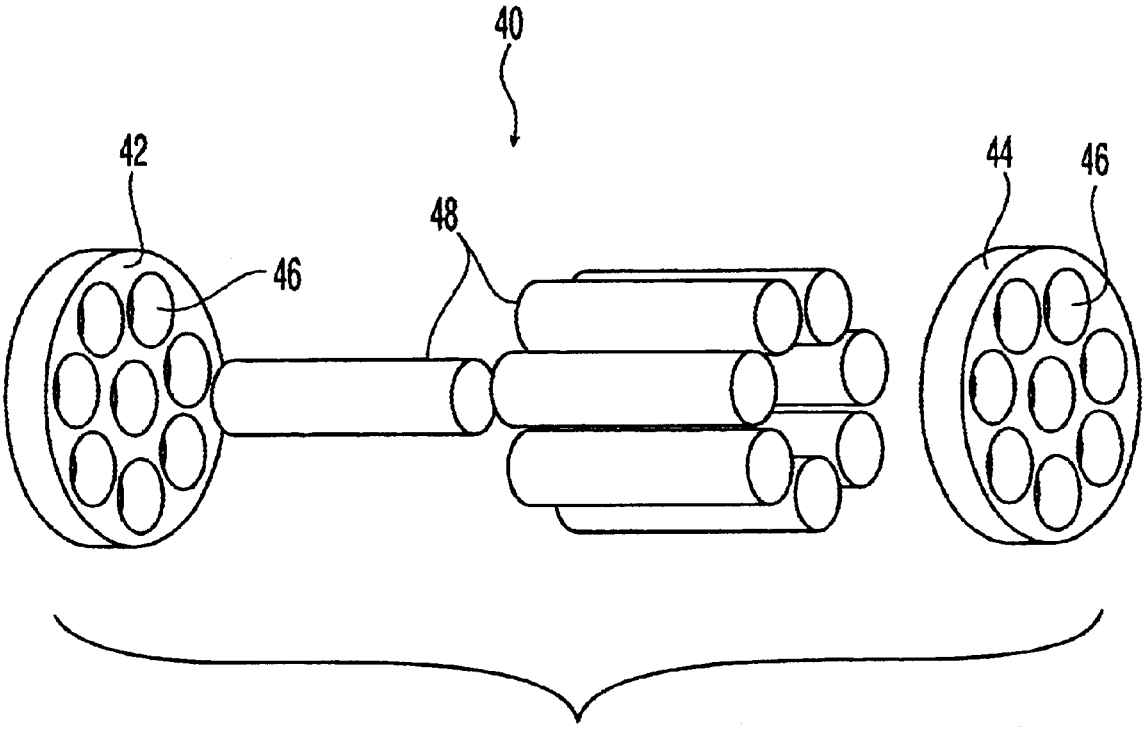
FIG. 4 is an exploded view of the multiple tubular pipe assembly shown in FIG. 2.

The details of the airflow pipe assembly 40 are best seen in FIGS. 3 and 4. First and second support plates are each provided with a plurality of holes 46 extending therethrough. The holes are arranged in a circle with one additional hole located concentrically of the circle of holes. A plurality of tubular pipes 48 having an external diameter substantially equal to the internal diameter of each hole 46 are secured at their opposite ends in the respective holes of the plates 42, 44 as best seen in FIG. 3. The pipes may be secured to the plates by any suitable means such as an adhesive, welding or the like depending upon the materials used. The entire assembly of pipes as shown in FIG. 3 is then inserted into the outlet conduit 26 as shown in FIG. 1 with the outer circumferences of the plates 42 and 44 being sealingly secured to the interior surface of the conduit 26 so that the entire airflow from the blower 10 is directed through the pipes. The plates 42, 44 may be connected to the conduit 26 by an adhesive or welding depending upon the materials used.

Figure 5:
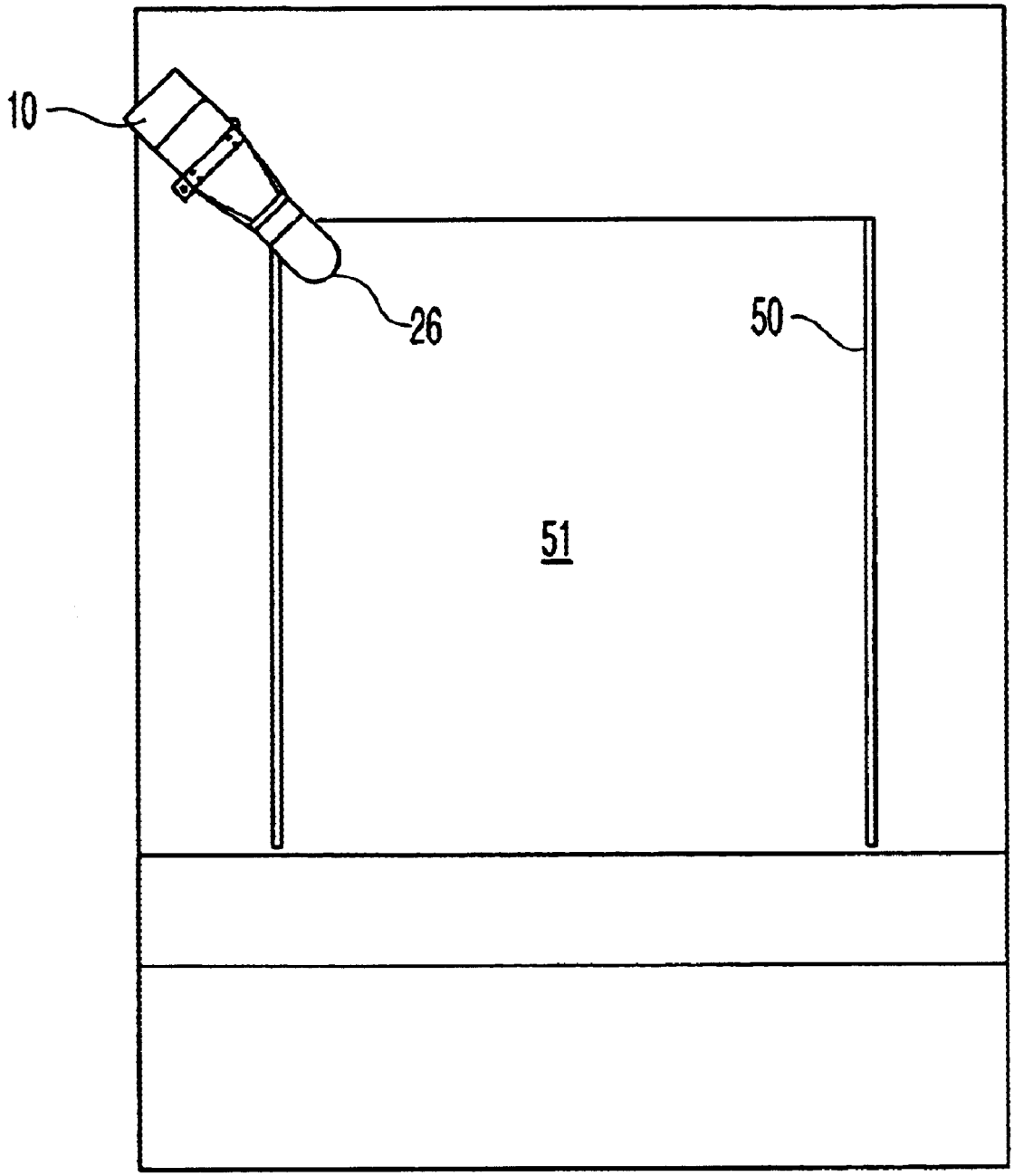
FIG. 5 is a schematic view showing the arrangement of the laminar airflow mover assembly relative to an open warehouse door and an open trailer adjacent thereto.

FIG. 5 is a schematic illustration of the arrangement of the laminar airflow mover assembly relative to a warehouse door opening 50 and the open rear end 51 of a trailer parked adjacent the door. The door opening 50 may be opened and closed by a conventional overhead door, not shown. The laminar flow air mover assembly is mounted adjacent the door opening 50 so that the outlet conduit 26 is positioned with the outlet end of the conduit 26 directed into the open trailer.

By using a centrifugal blower in combination with an outlet conduit having a plurality of parallel tubular pipes secured therein it is possible to provide a coherent flow of air for greater distances previously thought to be impossible. As a result it is possible to provide a more efficient air circulation means for the largest trailers available in the trucking industry.

What is claimed is:

1. A laminar flow air mover comprising a centrifugal blower having an outlet and a conduit system connected to said outlet of the centrifugal blower wherein said conduit system has an outlet portion with a plurality of tubes disposed in parallel to each other secured in said outlet portion; and wherein said conduit is comprised of a first portion detachably connected to said outlet of the centrifugal blower, an elbow portion connected to the first portion at one end and to said outlet portion of the conduit system at the opposite end thereof.

2. A laminar flow air mover as set forth in claim 1 wherein said conduit system has a circular cross section with the first section and the elbow section having a first diameter and said outlet portion having a second diameter smaller than said first diameter to create a back pressure to said centrifugal blower.

3. A laminar flow air mover as set forth in claim 2 wherein said plurality of tubes are of equal lengths with opposite ends of each tube being secured in apertures in a pair of spaced apart plates each having a diameter substantially equal to the diameter of said outlet portion of the conduit system whereby the entire airflow from said centrifugal blower must pass through said pipes.

4. A laminar flow air mover as set forth in claim 3 comprising a mounting bracket having first and second telescopically movable first and second pipes, said first pipe being connected to said centrifugal blower and the second pipe being connected to a mounting bracket for mounting the mover on a wall adjacent an opening wherein said first pipe is provided with a plurality of circumferentially disposed apertures and said second pipe is provided with a plurality of longitudinally disposed apertures and a pin adapted to extend through aligned apertures in said pipes to adjust the length and angular orientation of the pipes relative to each other.

5. A laminar flow air mover as set forth in claim 1, wherein the first portion of the conduit has a cylindrical portion having a plurality of inwardly directed protrusions and the outlet of the centrifugal blower has a cylindrical member adapted to fit in the cylindrical portion, said cylindrical member having a plurality of recesses aligned with said protrusions for receiving said protrusions.

* * * * *